US010253269B2

(12) United States Patent
Cantley et al.

(10) Patent No.: US 10,253,269 B2
(45) Date of Patent: Apr. 9, 2019

(54) METHOD TO MIGRATE FOULING OF A VACUUM WASH BED

(71) Applicant: Marathon Petroleum Company LP, Findlay, OH (US)

(72) Inventors: Gregory A. Cantley, Huntington, WV (US); James F. Johnson, Woodhaven, MI (US); Jeff Sexton, Findlay, OH (US)

(73) Assignee: Marathon Petroleum Company LP, Findlay, OH (US)

( * ) Notice: Subject to any disclaimer, the term of this patent is extended or adjusted under 35 U.S.C. 154(b) by 56 days.

(21) Appl. No.: 15/342,310

(22) Filed: Nov. 3, 2016

(65) Prior Publication Data

US 2017/0327749 A1 Nov. 16, 2017

Related U.S. Application Data

(60) Provisional application No. 62/251,285, filed on Nov. 5, 2015.

(51) Int. Cl.
*C10G 7/00* (2006.01)
*C10G 7/06* (2006.01)
*C10G 75/00* (2006.01)

(52) U.S. Cl.
CPC ..... *C10G 7/06* (2013.01); *C10G 75/00* (2013.01); *C10G 2300/807* (2013.01)

(58) Field of Classification Search
CPC ..... C10G 7/00; C10G 75/00; B01D 3/008; B01D 3/06; B01D 3/10; B01D 3/101; B01D 3/105
See application file for complete search history.

(56) References Cited

U.S. PATENT DOCUMENTS 5,076,910 A * 12/1991 Rush ..... C10G 7/06 208/100
5,972,171 A 10/1999 Ross et al.
2013/0186739 A1 7/2013 Trompiz
2013/0334027 A1* 12/2013 Winter ..... B01D 3/42 203/2
2014/0353138 A1 12/2014 Amale et al.

FOREIGN PATENT DOCUMENTS

EP 0783910 * 7/1994
EP 07839010 12/2000

OTHER PUBLICATIONS

Stuart Fraser, Distillation in Refining, Distillation Operation and Applications (2014), pp. 155-190 (Year: 2014).*

* cited by examiner

*Primary Examiner* — Prem C Singh
*Assistant Examiner* — Brandi M Doyle
(74) *Attorney, Agent, or Firm* — Schaffer, Schaub & Marriott Ltd.

(57) ABSTRACT

Fluid medium such as light cycle oil, water, FCC slurry and decanted oil, improve this method for vacuum distillation of a petroleum product. The method may be used in the petroleum refining industry for fractionating of petroleum base stock in a vacuum column. The fluid medium prevents the formation of thermoset polymers and the resultant fouling of the wash beds in the vacuum column.

6 Claims, 8 Drawing Sheets
(7 of 8 Drawing Sheet(s) Filed in Color)

Scan Results

Refinery A Vacuum Tower

Baseline Scan with New Packing

Scan 3 Years Later

Scan Results

Refinery B Vacuum Tower

Baseline Scan with New Packing

Scan 4.5Years Later

Vacuum Tower Wash Bed Coking

METHOD TO MIGRATE FOULING OF A VACUUM WASH BED

CROSS REFERENCE TO RELATED APPLICATION

The present patent application is based upon and claims the benefit of provisional patent application No. 62/251,285, tiled on Nov. 5, 2015.

TECHNICAL FIELD

This invention relates to a method for mitigating fouling of a vacuum tower wash bed during the vacuum distillation of a petroleum product. The invention may be used in the petroleum refining industry for fractionating of petroleum base stock in a vacuum column.

BACKGROUND OF THE INVENTION

Refinery fractionator wash beds are monitored for fouling/coking of the wash bed on a regular basis. The density of the fouling/coking in the wash beds increase over time, which allows for a prediction of the tower's ability to run efficiently over time.

When the fouling/coking of the wash bed becomes a serious impediment to operating efficiency, the entire process unit may be taken off-stream for an extended period for renewal of the wash beds. This is commonly referred to as a turn-around (TAR).

During a TAR cycle, after the vacuum heater trips and the wash bed temperature drops below 400° F., a density scans show an increase in the slope of the fouling/coking in the wash bed. It has been observed that a thermoset polymer is forming in the wash bed during operations. A thermoset polymer is a petrochemical in a soft-solid or viscous state that changes irreversibly when cured into an infusible, insoluble polymer network. Once the thermoset is cured, then the polymer can only be removed by physically changing the packing in the wash bed during a TAR.

SUMMARY OF THE INVENTION

A first embodiment of the invention utilizes a hydrocarbon solvent, such as light cycle oil (LCO), to wash the polymer out of the packing before the curing process occurs. The flushing of this soft-solid polymer is effected, upon shutdown of the heater, by introducing a large amount of the solvent to the bed at an elevated temperature (>500° F.) to move the material down the tower to be removed with the vacuum bottoms stream.

A second embodiment of the invention introduces the solvent continuously, during operations, at a much smaller injection rate, to hinder the buildup of the soft-solid or viscous polymer in the wash bed and thus prevent the therrnoset from ever forming.

In yet another embodiment, introduction of a fluid medium of steam can keep the wash bed temperature above 350° F.-400° F. to prevent the therrnoset from forming.

In still another embodiment, a combination of an LCO and steam is effective in preventing the formation of a therrnoset polymer in the wash beds.

Other objects and advantages of the present invention will become apparent to those skilled in the art upon a review of the following detailed description of the preferred embodiments and the accompanying drawings.

IN THE DRAWINGS

The application file contains at least one drawing executed in color. Copies of this patent or patent application publication with color drawings will be provided by the office upon request and payment of the necessary fee.

FIG. 8 shows vacuum tower mask bed coking.

DETAILED DESCRIPTION OF THE INVENTION

The cooling of the vacuum tower wash bed below 350° F. causes a thermoset polymer to form, which then cannot be removed except by mechanical means. An injection of a solvent such as LCO before the temperature of the wash drops below 350° F. removes the polymer before it hardens.

The LCO contains petroleum distillates. In one embodiment, the LCO is a complex mixture of paraffinic, cycloparaffinic, olefinic and aromatic hydrocarbons. The LCO is predominately C9-C25 hydrocarbons produced by the distillation of products from a catalytic cracking process. This stream is likely to contain a relatively large portion of bicyclical aromatic hydrocarbons.

In another embodiment, the fluid medium may be an FCC slurry or decanted oil. Typically the FCC slurry consists of aromatic hydrocarbons from FCC slurry oil processing technologies including hydrotreating, solvent refining and other separation techniques. Decanted oil may be a fluid catalytic cracker decanted oil, a heavy cycle oil, or a filtered decanted oil.

As an alternative to LCO steam can be introduced into the tower to keep the wash bed temperature above 350° F. to prevent the onset of thermoset polymer formation, with no significant change in wash bed performance.

In another embodiment, saturated steam may be introduced over a long period of time. Even if the wash bed cools to 350° F., the thermoset polymer will be kept from forming. While the preference is to inject the steam into the heater during the period of downtime, the continued introduction of stripping steam into the bottom of the column is adequate to prevent formation of the thermoset polymer.

Figure 2:
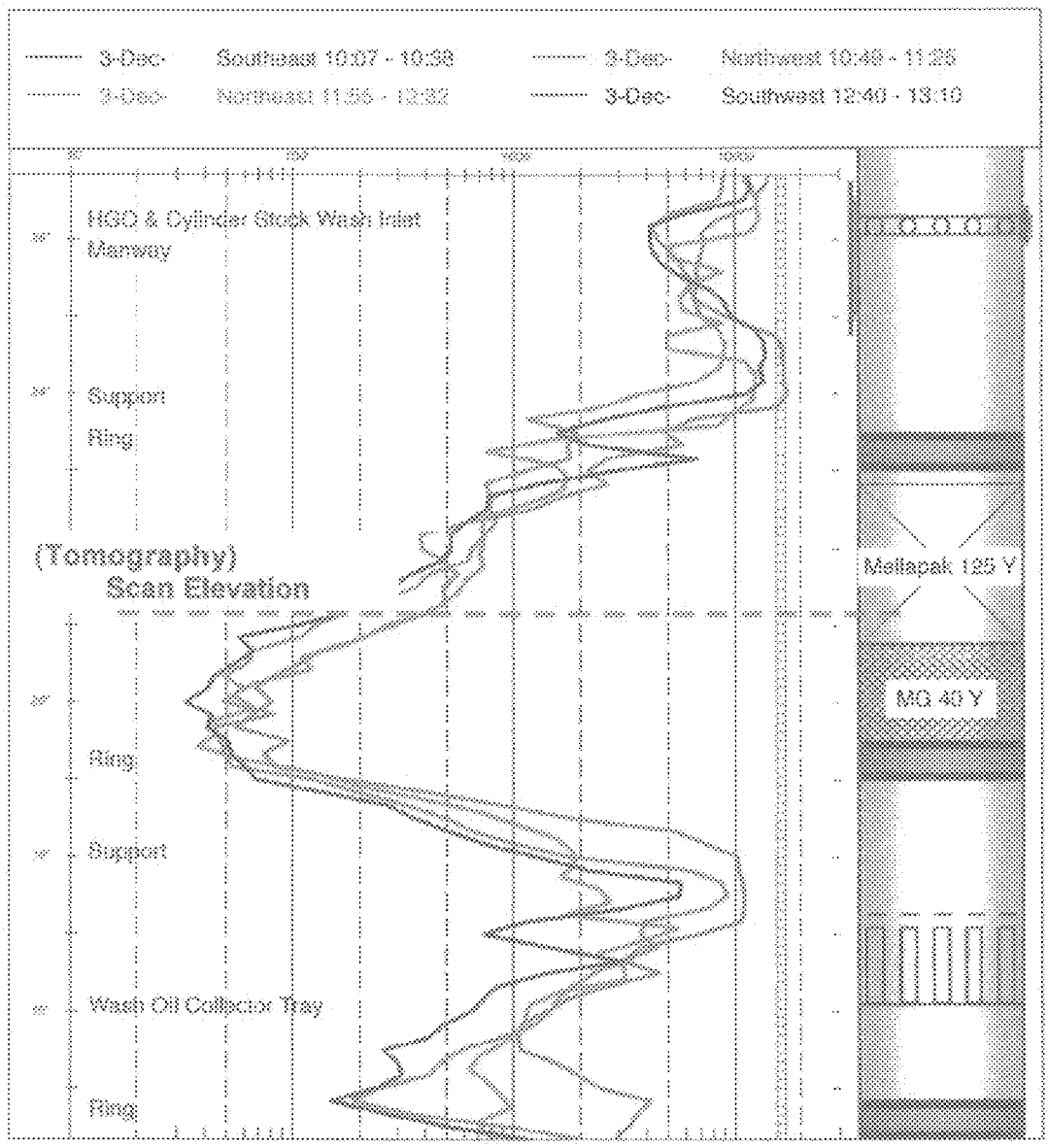
FIG. 2 is a graphical representation of a tomography scan elevation of a first tower.
Figure 5:
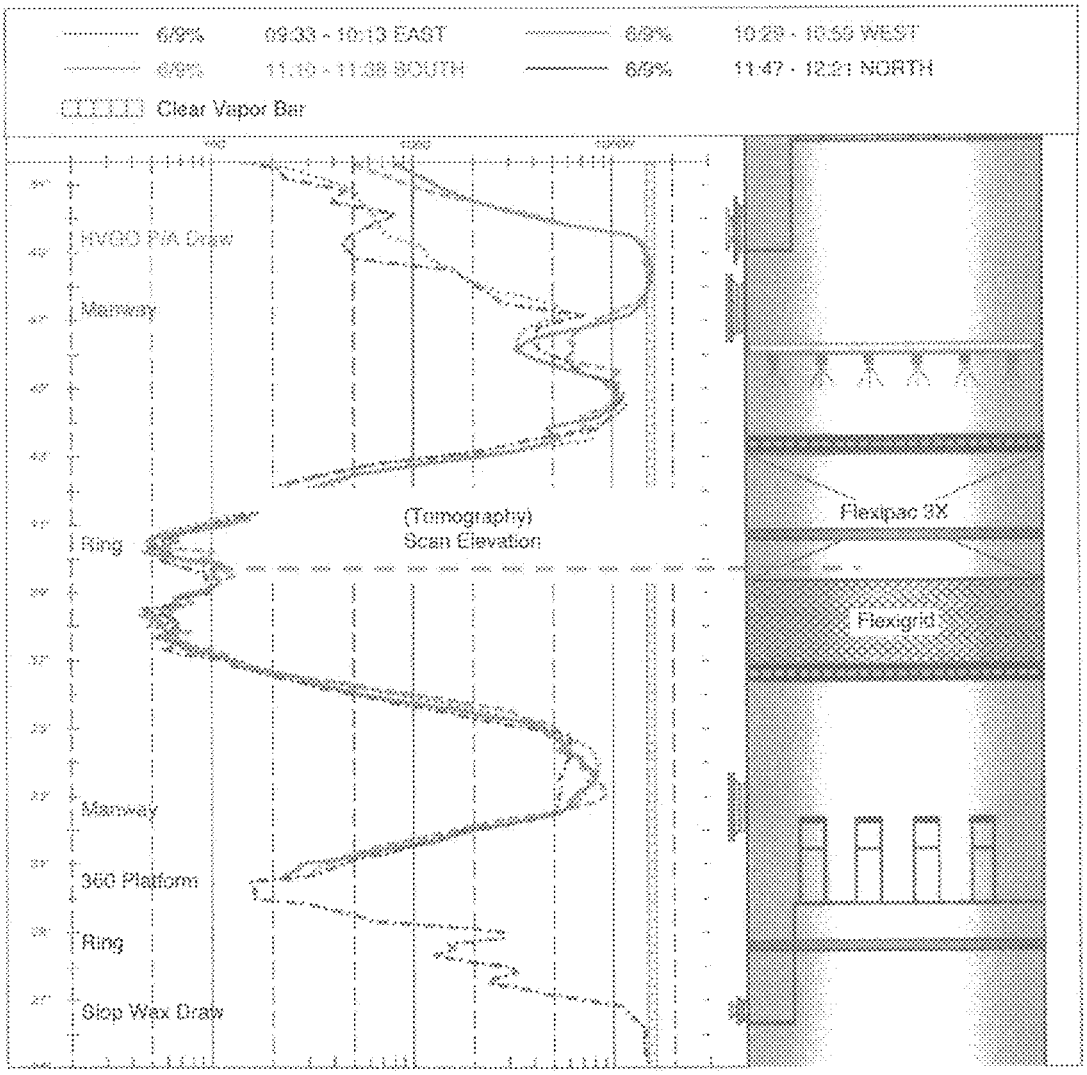
FIG. 5 is a graphical representation of a tomography scan elevation of a second tower.

Tomography scans such as shown in FIGS. 2 and 5 yield extensive cross-sectional information and data to monitor fouling/coking in packed beds. Tomography scans can be used to monitor wash bed coking and to make decisions on operating conditions to target cycle lengths for the tower.

Figure 1:
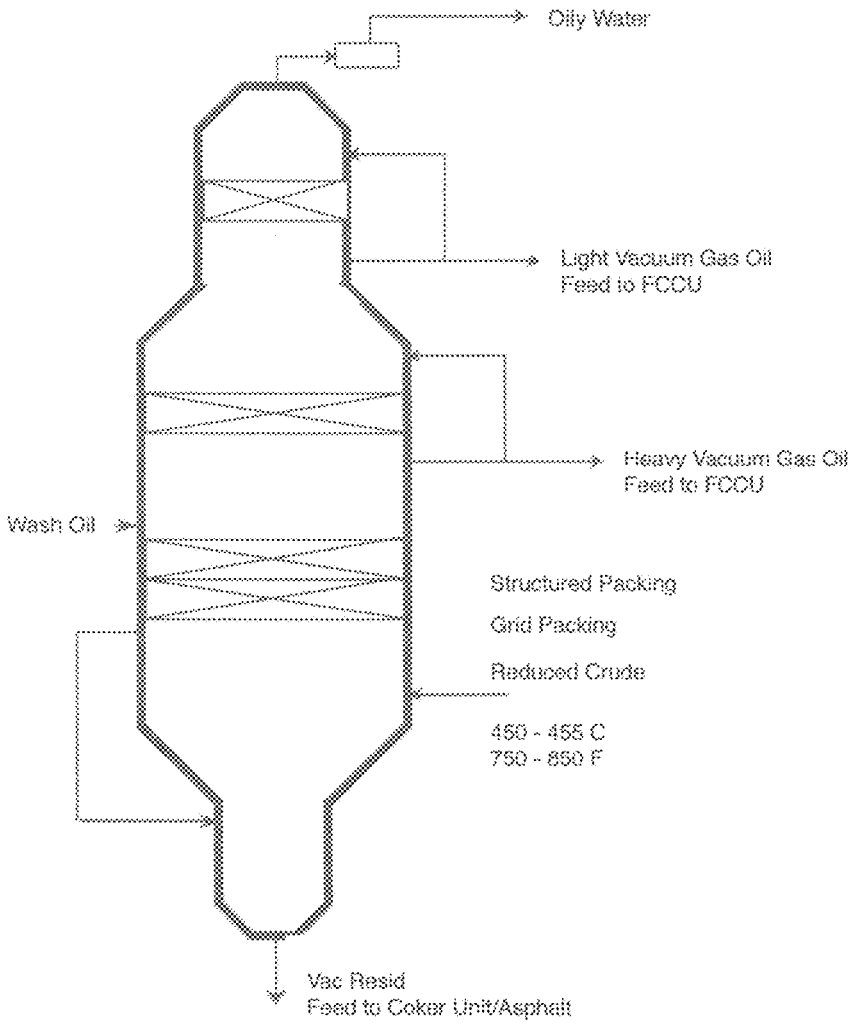
FIG. 1 is a schematic view of a typical vacuum distillation column.

FIG. 1 is a schematic view of a typical vacuum distillation column. FIG. 1 shows the introduction of a wash oil. The wash oil preferably is a hydrocarbon solvent, such as light cycle oil (LCO), to wash the polymer out of the packing before the curing process occurs. The injection of a solvent such as LCO before the temperature of the wash bed drops below 350° F. removes the polymer before it hardens.

FIG. 2 is a graphical representation of a tomography scan elevation of a first tower. The scan is a baseline scan with new packing.

Figure 3:
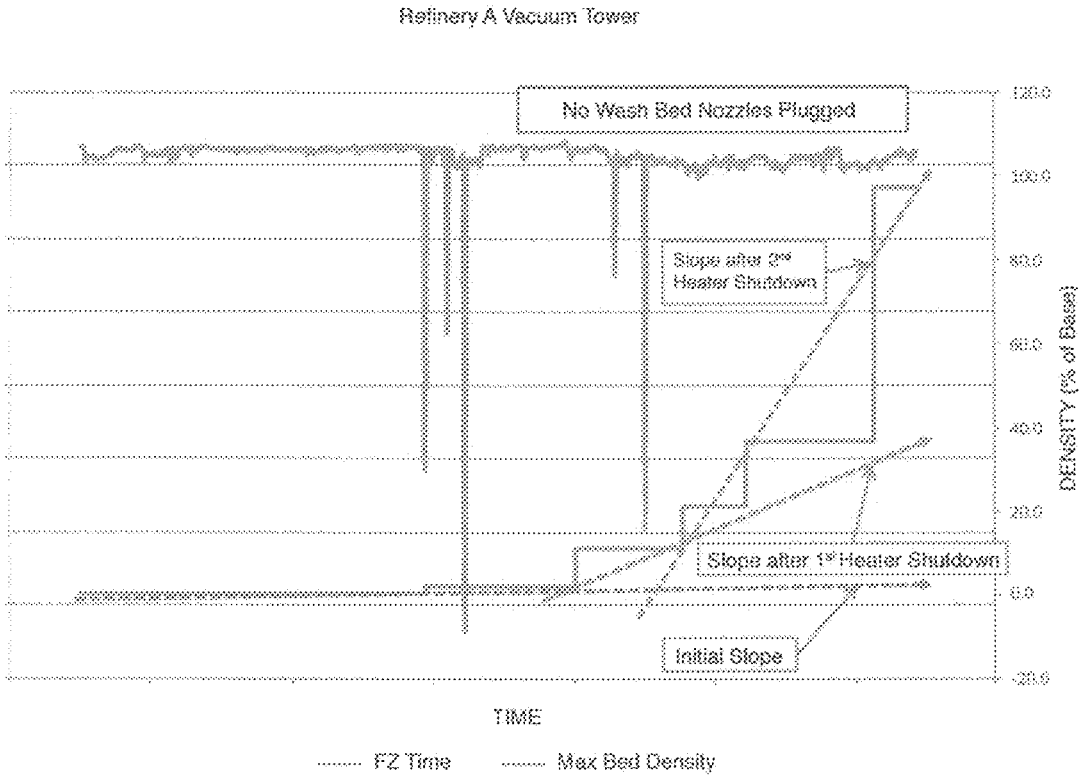
FIG. 3 is a graphical representation of slope density of the tower of FIG. 2 over time.

FIG. 3 is a graphical representation of slope density of the tower of FIG. 2 over time. The scans were measured over a period of 3 years. The bed density increased with time. The graphical representation shows the improved design and operation of this invention in refinery distillation.

Figure 4:
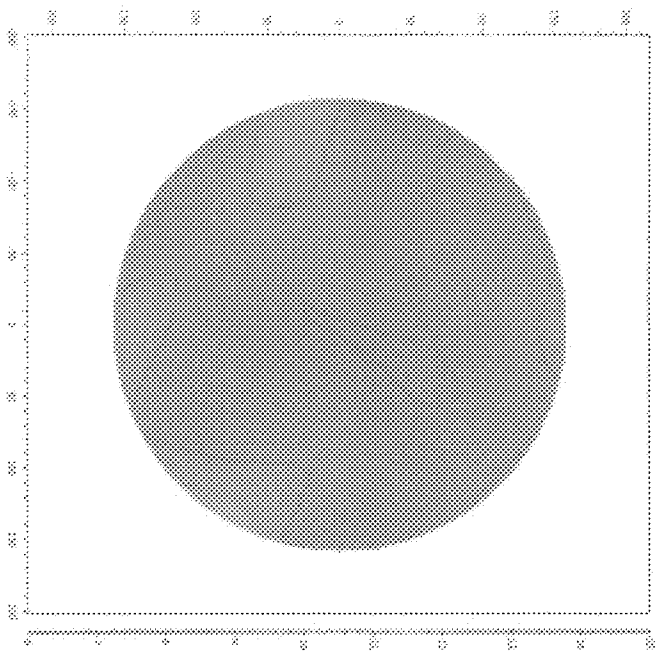
FIG. 4 shows a scan of new packing and a scan of the new packing of the tower of FIG. 2 three years later.
Figure 4:
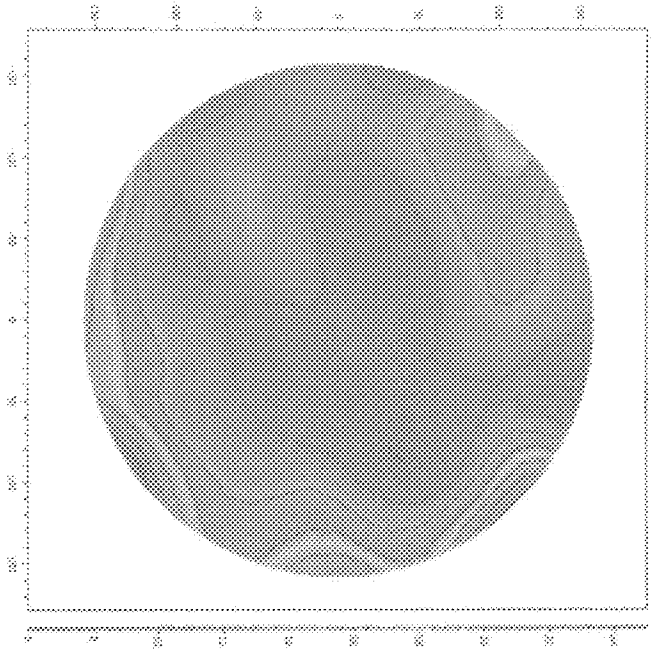

FIG. 4 shows a scan of new packing and a scan of the new packing of the tower of FIG. 2 three years later. The baseline scan with new packing shows no thermoset forming. The scan 3 years later shows some thermoset forming.

FIG. 5 is a graphical representation of a tomography scan elevation of a second tower. The scan is similar to the scan of FIG. 1.

Figure 6:
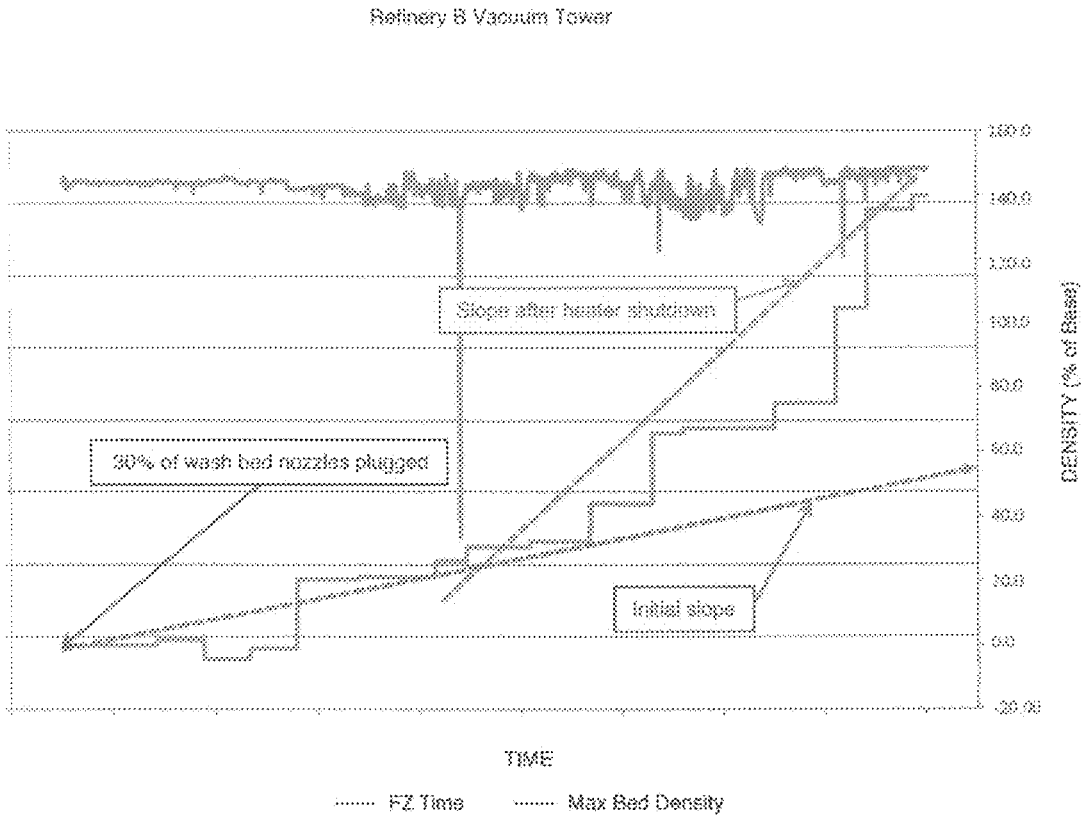

FIG. 6 is a graphical representation of slope density of the tower of FIG. 5 over time The scans were measured over a period of time of about 4.5 years. The bed density increased with time. The graphical representation shows the improved design and operation of this invention in refinery distillation.

Figure 7:
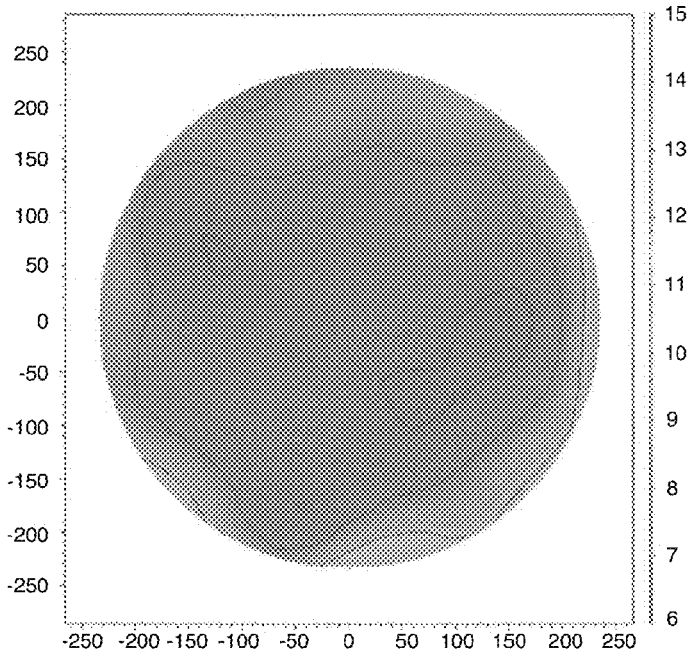
FIG. 7 shows a scan of new packing and a scan of the new packing of the tower of FIG. 5, four and one half years later.
Figure 7:
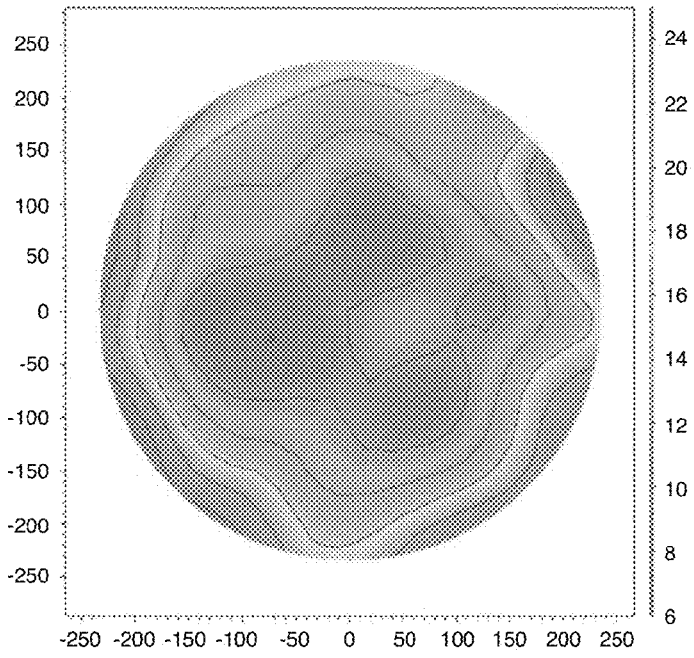

FIG. 7 shows a scan of new packing and a scan of the new packing of the tower of FIG. 5 four and one half years later. The baseline scan with new packing shows no thermoset forming. The scan 4.5 years later shows some thermoset forming. However, the representation shows the improved design and operation of this invention in refinery distillation.

Figure 8:
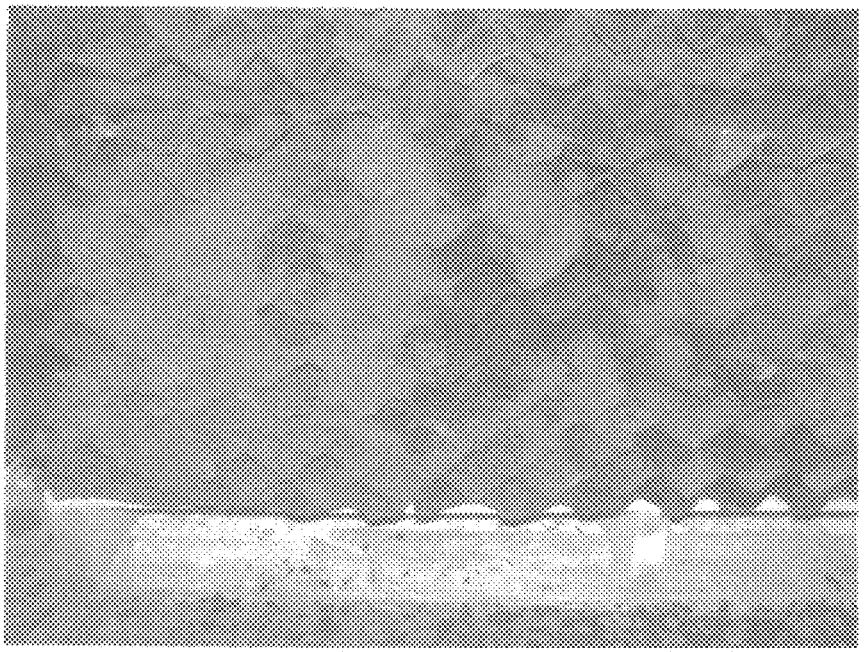
FIG. 8 is a graphical representation of slope density of the tower of FIG. 5 over time.
Figure 8:
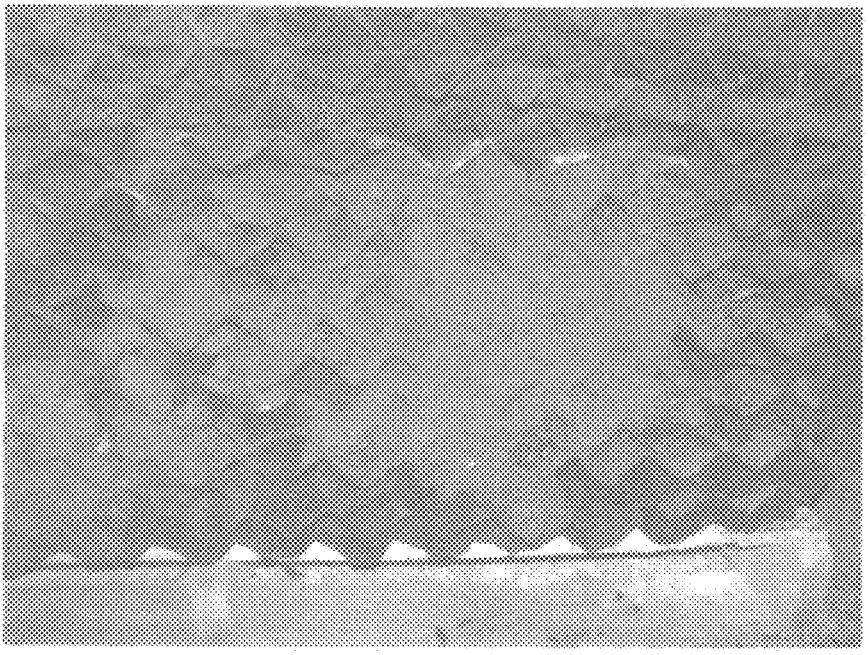

FIG. 8 shows vacuum tower wash bed coking. The thermoset cannot be melted after curing. Once the "hard candy" (thermoset) has setup in the packing, the packing eventually must be discarded.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A method of preventing buildup, fouling, and hardening of thermal set polymer in a vacuum distillation column wash bed, comprising the steps of:

delivering a light cycle oil solvent (LCO) to the wash bed to hinder the build up of a soft polymer in the wash bed;

preventing the soft polymer from hardening into a permanent foulant in the wash bed; and removing the soft polymer from the wash bed and vacuum distillation column.

2. A method according to claim 1 wherein the LCO contains petroleum distillates.

3. A method according to claim 1 wherein the LCO is a complex mixture of paraffinic, cycloparaffinic, olefinic, and aromatic hydrocarbons.

4. A method according to claim 1 wherein the LCO comprises C9-C25 hydrocarbons.

5. A method according to claim 1 wherein the LCO comprises bicyclical aromatic hydrocarbons.

6. A method according to claim 1 wherein the fluid medium is a combination of steam and a Sight cycle oil solvent (LCO).

* * * * *